US006749333B2

(12) United States Patent
Scheufele

(10) Patent No.: US 6,749,333 B2
(45) Date of Patent: Jun. 15, 2004

(54) TOURBILLON MECHANISM

(75) Inventor: Karl-Friedrich Scheufele, Prangins (CH)

(73) Assignee: Chopard Manufacture S.A., Fleurier (CH)

( * ) Notice: Subject to any disclaimer, the term of this patent is extended or adjusted under 35 U.S.C. 154(b) by 0 days.

(21) Appl. No.: 10/396,500

(22) Filed: Mar. 26, 2003

(65) Prior Publication Data

US 2003/0185105 A1 Oct. 2, 2003

(30) Foreign Application Priority Data

Mar. 26, 2002 (EP) ..... 02006869

(51) Int. Cl.[7] ..... G04B 15/00; G04B 19/20
(52) U.S. Cl. ..... 368/127; 368/142
(58) Field of Search ..... 368/76, 77, 124–128, 368/139, 144, 220

(56) References Cited

U.S. PATENT DOCUMENTS 5,608,694 A * 3/1997 Grimm et al. ..... 368/127
5,838,641 A * 11/1998 Tohkoku et al. ..... 368/127
6,402,368 B1 * 6/2002 Grimm et al. ..... 368/127

FOREIGN PATENT DOCUMENTS

CH 33816 1/1906
CH 254850 5/1948

* cited by examiner

*Primary Examiner*—Vit W. Miska
(74) *Attorney, Agent, or Firm*—Young & Thompson

(57) ABSTRACT

A tourbillon mechanism comprises a cage (1), an escapement wheel (3), an anchor (5) and a balance wheel. The cage (1) comprises an upper portion (1*a*) and a lower portion (1*b*) with cylindrical skirts and adapted to be superposed on each other. Moreover, the cage (1) is associated with a monolithic bridge (7) ensuring the positioning of the escapement wheel (3) and of the anchor (5). The cage is of aluminum alloy treated by anodic oxidation.

14 Claims, 1 Drawing Sheet

TOURBILLON MECHANISM

Figure 1:
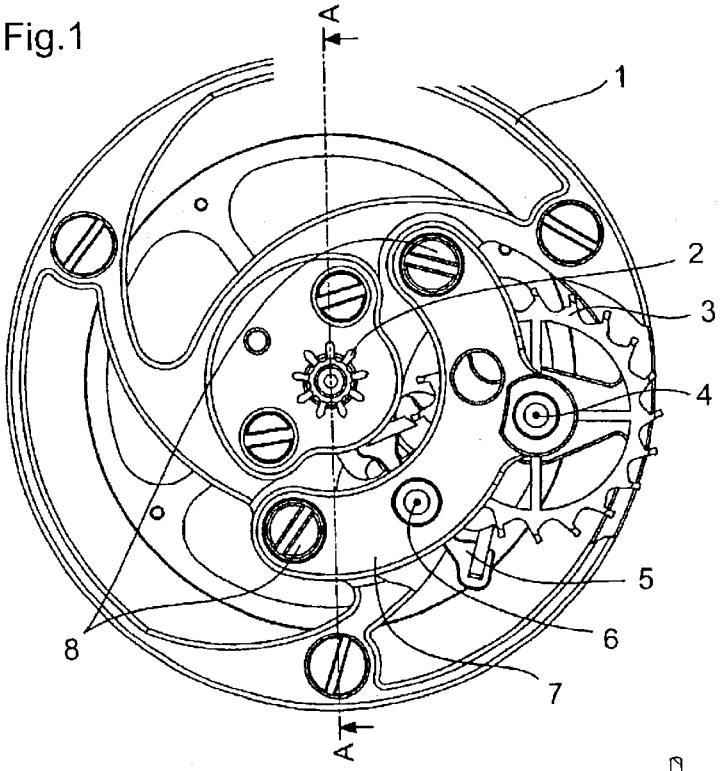

The present invention relates to a tourbillon mechanism adapted to improve the precision of operation of the regulating member and more particularly to improve the mechanical construction of such a mechanism, leading to higher precision of positioning of the pieces forming these mechanisms.

Tourbillon mechanisms have been known from the first device of this type designed by A. -L. Breguet in 1801 in a variety of embodiments.

Such a mechanism comprises a cage mounted pivotally in the case of the timepiece in question, this cage carrying all the escapement members and the regulator member. Due to the complexity and to the above-mentioned object of such a mechanism, all the elements of a tourbillon mechanism must be among other things positioned as precisely as possible.

Despite a large number of different embodiments of these mechanisms, the association and/or arrangement of several pieces in the conventional tourbillon mechanisms is still not optimal.

This relates first of all to the cage, which is comprised normally of an upper portion and a lower portion which were until now secured to each other by means of screw threaded posts. This conventional solution gives rise to problems as to the concentricity of all the elements of the cage relative to the access of the balance wheel and also as to the rigidity and weight of the cage as well as its assembly.

Moreover, the anchor and the escapement wheel are subject to conceivable improvements relating among other things to their positioning relative to each other with the help of the cage, even on an element fixed to this latter, so as to increase the precision of this positioning and the guidance of the elements during operation of the mechanism.

The object of the present invention is to overcome the mentioned drawbacks and to permit the production of a simple tourbillon mechanism with a reduced number of pieces and reduced weight, ensuring at the same time the concentricity of the elements and the rigidity of the cage as well as guaranteeing the easy and precise positioning of the anchor and the escapement wheel on the cage, simultaneously ensuring better guidance of this latter.

The object of the present invention is accordingly a tourbillon mechanism which is distinguished by the characteristics set forth in claims 1 and 6 and/or in the dependent claims.

The drawing shows schematically and by way of example an embodiment of a tourbillon mechanism according to the present invention.

FIG. 1 shows the cage of the tourbillon mechanism and the elements mounted on the cage, specifically a monolithic bridge for mounting of the anchor and the escapement wheel.

Figure 2A:
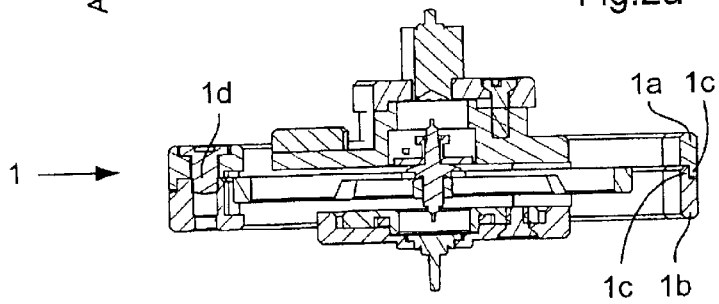
Figure 2B:
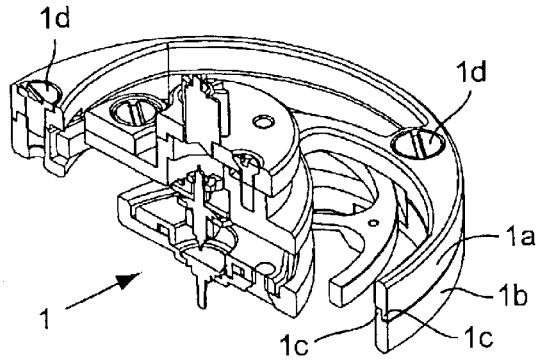

FIGS. 2*a* and 2*b* show cross-sections of the cage on the line A—A of FIG. 1, one in plan and the other in perspective.

Figure 3:
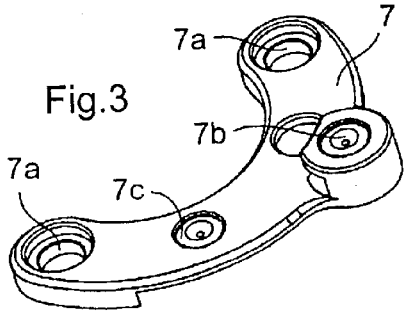

FIG. 3 is a perspective view of the monolithic bridge adapted for the positioning of the escapement wheel and the anchor.

In what follows, the embodiment of the present invention will be described in detail with the help of the above drawings.

A tourbillon mechanism according to the present invention comprises, as shown schematically in FIG. 1, a cage 1 which is mounted pivotably about a pinion 2 in the case of the timepiece with which it is associated. As shown in FIG. 2, this cage comprises an upper portion 1*a* and a lower portion 1*b* adapted to be superposed on each other so as to form the cage 1. Contrary to the conventional solution for assembling this cage with the help of three or four screw posts disposed between these two portions at an approximately equal angular distance about their periphery, the solution envisaged by the present invention ensures the equidistance of the two planes of the upper portion 1*a* and lower portion 1*b* as well as their concentricity and coaxiality all along their periphery. Whilst thereby decreasing the number of pieces forming the cage 1 of the mechanism and, as a result, by facilitating the assembly of the cage 1, its rigidity is higher relative to the conventional solution known to date.

The assembly of the cage, see also the diagram of FIG. 2, takes place by means of cylindrical skirts on the upper portion 1*a* and lower portion 1*b*, which is to say walls forming substantially a cylindrical body, these cylindrical skirts being adapted to be associated so as to form together the cage. Positioning elements 1*c* of different shapes can ensure the desired orientation and positioning of the upper and lower portions 1*a* and 1*b* relative to each other. Preferably, these positioning elements 1*c* are embodied by providing the cylindrical skirts of the upper and lower portions 1*a* and 1*b* at their end oriented at the center of the cage 1, with a radial constriction, one within and the other outside, as shown in FIGS. 2*a* and 2*b*, such that the two portions 1*a* and 1*b* fit together and are positioned precisely one relative to the other and relative to the axis of the balance wheel. These two portions 1*a* and 1*b* are thus guided as to their positioning by their cylindrical skirts and more specifically by their positioning elements 1*c* or interfitting formations, which is to say by elements concentric to the axis of the cage 1, such that the axis of the cage 1 will be perfectly aligned on the same axis as the balance wheel, thereby defining an optimum concentricity.

Finally, the securement of the pieces can take place by means of different solutions, for example with the help of screws 1*d* disposed in openings provided for this purpose in the cylindrical skirts of the upper and lower portions 1*a* and 1*b*; the skirts can be locally thicker at positions provided with these openings adapted to receive the screws 1*d*, these skirts preferably interconnecting the points of the cage made of one piece with said skirts bearing the other elements which are not important to the scope of the present invention and will accordingly not be described in detail.

The two portions 1*a*, 1*b* of the cage are produced from an aluminum alloy treated by anodic oxidation. In addition to the rigidity of this material and the advantages resulting therefrom mentioned above, this renders the cage also lighter than a cage made in the usual manner with three conventional posts.

Thus, the present invention provides several advantages, namely a reduced number of pieces and easy assembly of the cage 1, reduced weight, higher rigidity and above all improved precision as to the concentricity of the pieces forming the cage 1 and of the elements mounted on these latter relative to the axis of the balance wheel.

Moreover, a tourbillon mechanism according to the present invention comprises a cage 1 associated with a monolithic bridge 7, which is to say of a single piece, which ensures the positioning of an escapement wheel 3 and simultaneously of an anchor 5 and which is shown schematically in FIG. 3. The monolithic bridge 7 preferably has substantially the shape of a circular segment which surrounds the elements at the center of the cage and which is provided with openings and recesses. This monolithic bridge 7 is concentric to the axis of the cage 1 of the tourbillon.

The escapement wheel 3 is mounted pivotably about a pinion of the escapement wheel 4, the anchor 5 is mounted about an anchor pin 6. These two fixtures 4 and 6 are both mounted, in the case shown in FIG. 1, at their upper end, on the monolithic bridge 7 in two bearings 7*b* and 7*c* receiving the pivots of the anchor and of the escapement wheel such that the anchor 5 can operate with the escapement wheel for the normal operation of a tourbillon mechanism which operation is not essential to the invention. As shown in FIG. 3, this monolithic bridge 7 can comprise a pinion bearing 7*b* to accommodate the pivot of the escapement pinion which is adapted to engage with still other wheels. The mounting of the anchor 5 and the escapement wheel 3 on a monolithic bridge improves the precision of their mutual positioning and their guidance. Moreover, such a system renders the tourbillon mechanism and its cage 1 provided with this monolithic bridge 7 more compact.

The securement of the monolithic bridge 7 to the cage 1 also takes place preferably with the help of screws disposed in openings 7*a* provided for this purpose at the two ends of the monolithic bridge 7 and by corresponding screw threads provided in guidance tubes themselves sunk into the arms of the upper portion of the cage 1.

The assembly of the cage 1 associated with the monolithic bridge 7 permits ensuring improved precision relative to the state of the art as to the concentricity of the axis of the cage 1 and of the balance wheel, as well as the positioning of the escapement wheel 3 and the anchor 5, and thereby contributes to improving the precision of operation of the regulator member.

In a modification, it is obvious that the monolithic bridge 7 could be used with a conventional tourbillon cage with screwed posts for other securement of the upper and lower cages.

Similarly, the cage 1 with interfitting cylindrical skirts could be used with two bridges, one for the pivoting of the anchor and the other for that of the escapement wheel.

What is claimed is:

1. Tourbillon mechanism comprising a cage (1), an escapement wheel (3), an anchor (5) and a balance wheel, characterized by the fact that the cage (1) comprises an upper portion (1*a*) and a lower portion (1*b*) adapted to be superposed on each other, these upper and lower portions (1*a*, 1*b*) of the cage comprising cylindrical skirts at their periphery adapted to be assembled and to guide the positioning of the cage (1) concentrically to the axis of the balance wheel.

2. Mechanism according to claim 1, characterized by the fact that the cylindrical skirts at the periphery of the upper and lower portions (1*a*, 1*b*) of the cage (1) comprise positioning elements (1*c*) in the shape of a radial constriction ensuring the alignment of the axis of the cage (1) and the axis of the balance wheel.

3. Mechanism according to claim 1, characterized by the fact that the upper portion (1) and the Lower portion (1*b*) of the cage (1) are fixed to each other with the help of screws (1*d*) disposed in openings provided for this purpose.

4. Mechanism according to claim 3, characterized by the fact that the cylindrical skirts of the upper and lower portions (1*a*, 1*b*) of the cage (1) are thickened in the regions provided with openings adapted to receive the screws (1*d*).

5. Mechanism according to claim 1, characterized by the fact that the cage (1) is of an aluminum alloy treated by anodic oxidation.

6. Tourbillon mechanism comprising a cage (1), an escapement wheel (3), an anchor (5) and a balance wheel, characterized by the fact that the cage (1) comprises an upper portion (1*a*) and a lower portion (1*b*) adapted to be assembled with each other and by the fact that the cage (1) comprises a monolithic bridge (7) fixed on one of the portions (1*a*, 1*b*) of the cage 1 provided with bearings receiving one of the ends of the pivots of the escapement wheel (3) and of the anchor (5) ensuring the precise positioning of the anchor (5) relative to the escapement wheel (3).

7. Mechanism according to claim 6, characterized by the fact that the monolithic bridge (7) has substantially the shape of a circular segment.

8. Mechanism according to claim 6, characterized by the fact that the monolithic bridge (7) is fixed on a cage (1) by screws disposed in openings (7*a*) provided for this purpose in the monolithic bridge (7) coacting with screw threads of corresponding guide tubes sunk into the cage (1).

9. Mechanism according to claim 6, characterized by the fact that the cage (1) comprises an upper portion (1*a*) and a lower portion (1*b*) adapted to be superposed on each other, these upper and lower portions (1*a*, 1*b*) of the cage comprising cylindrical skirts at their periphery adapted to be associated and to guide the positioning of the cage (1) concentrically to the axis of the balance wheel.

10. Mechanism according to claim 9, characterized by the fact that the cage (1) is of an aluminum alloy treated by anodic oxidation.

11. Mechanism according to claim 7, characterized by the fact that the monolithic bridge is concentric to the tourbillon cage.

12. Mechanism according to claim 7, characterized by the fact that the monolithic bridge (7) is fixed on a cage (1) by screws disposed in openings (7*a*) provided for this purpose in the monolithic bridge (7) coacting with screw threads of corresponding guide tubes sunk into the cage (1).

13. Mechanism according to claim 7, characterized by the fact that the cage (1) comprises an upper portion (1*a*) and a lower portion (1*b*) adapted to be superposed on each other, these upper and lower portions (1*a*, 1*b*) of the cage comprising cylindrical skirts at their periphery adapted to be associated and to guide the positioning of the cage (1) concentrically to the axis of the balance wheel.

14. Mechanism according to claim 8, characterized by the fact that the cage (1) comprises an upper portion (1*a*) and a lower portion (1*b*) adapted to be superposed on each other, these upper and lower portions (1*a*, 1*b*) of the cage comprising cylindrical skirts at their periphery adapted to be associated and to guide the positioning of the cage (1) concentrically to the axis of the balance wheel.

* * * * *